US011126109B2

(12) United States Patent
Shimizu

(10) Patent No.: US 11,126,109 B2
(45) Date of Patent: Sep. 21, 2021

(54) DEVELOPING CARTRIDGE INCLUDING COUPLING AND CLUTCH FOR ALLOWING ROTATION OF COUPLING IN FIRST DIRECTION AND STOPPING ROTATION OF COUPLING IN SECOND DIRECTION

(71) Applicant: BROTHER KOGYO KABUSHIKI KAISHA, Nagoya (JP)

(72) Inventor: Keita Shimizu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/578,858

(22) Filed: Sep. 23, 2019

(65) Prior Publication Data

US 2020/0019085 A1 Jan. 16, 2020

Related U.S. Application Data

(63) Continuation of application No. PCT/JP2018/011008, filed on Mar. 20, 2018.

(30) Foreign Application Priority Data

Apr. 28, 2017 (JP) ..... JP2017-089273

(51) Int. Cl.
*G03G 15/08* (2006.01)
*G03G 21/16* (2006.01)
(Continued)

(52) U.S. Cl.
CPC ..... *G03G 15/0808* (2013.01); *G03G 15/0121* (2013.01); *G03G 15/757* (2013.01);
(Continued)

(58) Field of Classification Search
CPC ..... G03G 15/0121; G03G 15/757; G03G 21/1647; G03G 21/1676; G03G 21/1857;
(Continued)

(56) References Cited

U.S. PATENT DOCUMENTS

2006/0051134 A1 3/2006 Ahn et al.
2006/0072934 A1 4/2006 Fukuta
(Continued)

FOREIGN PATENT DOCUMENTS

CN 1330293 1/2002
CN 1862410 A 11/2006
(Continued)

OTHER PUBLICATIONS

International Preliminary Report on Patentability issued in related International Patent Application No. PCT/JP2018/011008, dated Oct. 29, 2019.

(Continued)

*Primary Examiner* — Joseph S Wong
(74) *Attorney, Agent, or Firm* — Merchant & Gould P.C.

(57) ABSTRACT

A developing cartridge includes: a developing roller; a coupling for rotating the developing roller; a shaft; and a clutch. The developing roller is rotatable about a first axis extending in an axial direction. The coupling is rotatable about a second axis extending in the axial direction. The shaft rotatably supports the coupling. The clutch is rotatable together with the coupling about the shaft in a case where the coupling rotates in a first rotational direction. In a case where the coupling rotates in a second rotational direction opposite to the first rotational direction, the clutch engages with a portion of the shaft and the clutch and the coupling do not rotate.

28 Claims, 10 Drawing Sheets

(51) Int. Cl.
*G03G 15/00* (2006.01)
*G03G 21/18* (2006.01)
*G03G 15/01* (2006.01)

(52) U.S. Cl.
CPC ..... *G03G 21/1647* (2013.01); *G03G 21/1676* (2013.01); *G03G 21/186* (2013.01); *G03G 21/1857* (2013.01); *G03G 21/1864* (2013.01)

(58) Field of Classification Search
CPC ..... G03G 21/186; G03G 21/864; G03G 2221/1654; G03G 2221/1657; G03G 21/1864; G03G 15/0808
See application file for complete search history.

(56) References Cited

U.S. PATENT DOCUMENTS

| | | | | |
|---|---|---|---|---|
| 2006/0257166 | A1* | 11/2006 | Ahn | G03G 15/757 399/167 |
| 2008/0190242 | A1* | 8/2008 | Kim | G03G 21/1647 74/84 R |
| 2015/0192891 | A1 | 7/2015 | Noda et al. | |
| 2015/0321866 | A1 | 11/2015 | Koyama | |

FOREIGN PATENT DOCUMENTS

| | | | |
|---|---|---|---|
| CN | 101285518 | A | 10/2008 |
| JP | 10-316258 | A | 12/1998 |
| JP | 2006-98770 | A | 4/2006 |
| JP | 2007-24973 | A | 2/2007 |
| JP | 2010-204384 | A | 9/2010 |
| JP | 2013-129536 | A | 7/2013 |
| JP | 2014-197146 | A | 10/2014 |
| JP | 2015-129806 | A | 7/2015 |
| JP | 2015-215017 | A | 12/2015 |
| WO | 2013/132572 | A1 | 9/2013 |
| WO | 2015/083842 | A1 | 6/2015 |

OTHER PUBLICATIONS

International Search Report and Written Opinion issued in PCT/JP2018/011008, dated May 15, 2018.
Extended European Search Report issued in corresponding European Patent Application No. 18789811.9, dated Dec. 3, 2020.
Notice of Allowance issued in correspondence Chinese Patent Application No. 201880028005.1, dated Jul. 14, 2021.

* cited by examiner

DEVELOPING CARTRIDGE INCLUDING COUPLING AND CLUTCH FOR ALLOWING ROTATION OF COUPLING IN FIRST DIRECTION AND STOPPING ROTATION OF COUPLING IN SECOND DIRECTION

CROSS REFERENCE TO RELATED APPLICATION

This application is a by-pass continuation of International Application No. PCT/JP2018/011008 filed Mar. 20, 2018 claiming a priority from Japanese Patent Application No. 2017-089273 filed Apr. 28, 2017. The entire contents of the priority application and the international application are incorporated herein by reference.

TECHNICAL FIELD

The present disclosure relates to a developing cartridge including a coupling to which driving force is inputted.

BACKGROUND

Conventionally, there is known a developing cartridge including a developing roller and a coupling.

SUMMARY

For example, when the developing cartridge is attached to an image forming apparatus, the coupling receives driving force from the image forming apparatus and rotates in a first rotational direction. Then, the developing roller rotates in accordance with the rotation of the coupling in the first rotational direction. By this, the image forming apparatus can perform image formation. In this case, if the coupling rotates in a second rotational direction opposite to the first rotational direction, the developing roller may rotate in a reverse direction which is opposite to the rotational direction for the image formation and thus leakage of developing agent may occur.

In view of the foregoing, it is an object of the present disclosure to provide a developing cartridge capable of suppressing the coupling from rotating in the second rotational direction which is opposite to the first rotational direction.

In order to attain the above object and other objects, the present disclosure provides a developing cartridge including: a developing roller; a coupling for rotating the developing roller; a shaft; and a clutch. The developing roller is rotatable about a first axis extending in an axial direction. The coupling is rotatable about a second axis extending in the axial direction. The shaft rotatably supports the coupling. The clutch is rotatable together with the coupling about the shaft in a case where the coupling rotates in a first rotational direction. In a case where the coupling rotates in a second rotational direction opposite to the first rotational direction, the clutch engages with a portion of the shaft and the clutch and the coupling do not rotate.

BRIEF DESCRIPTION OF THE DRAWINGS

The particular features and advantages of the embodiment(s) as well as other objects will become apparent from the following description taken in connection with the accompanying drawings, in which:

FIG. 7(*b*) is a perspective view illustrating the clutch as viewed from the other side in the first direction.

FIG. 8(*b*) is a perspective view illustrating the coupling as viewed from the other side in the first direction;

FIG. 8(*c*) is a plan view illustrating the coupling as viewed from the other side in the first direction;

FIG. 8(*d*) is a cross-sectional view of a first protruding piece of the coupling taken along a plane X-X extending in a rotational direction;

FIGS. 9(*b*) is a view illustrating the positional relationship among the portions of the coupling, the clutch, and a shaft when the clutch is positioned at the first position;

FIG. 10(*b*) is a view illustrating the positional relationship among the portions of the coupling, the clutch, and the shaft when the clutch is positioned at the second position.

DETAILED DESCRIPTION

An embodiment of the present disclosure will be described while referring to the accompanying drawings.

Figure 1:
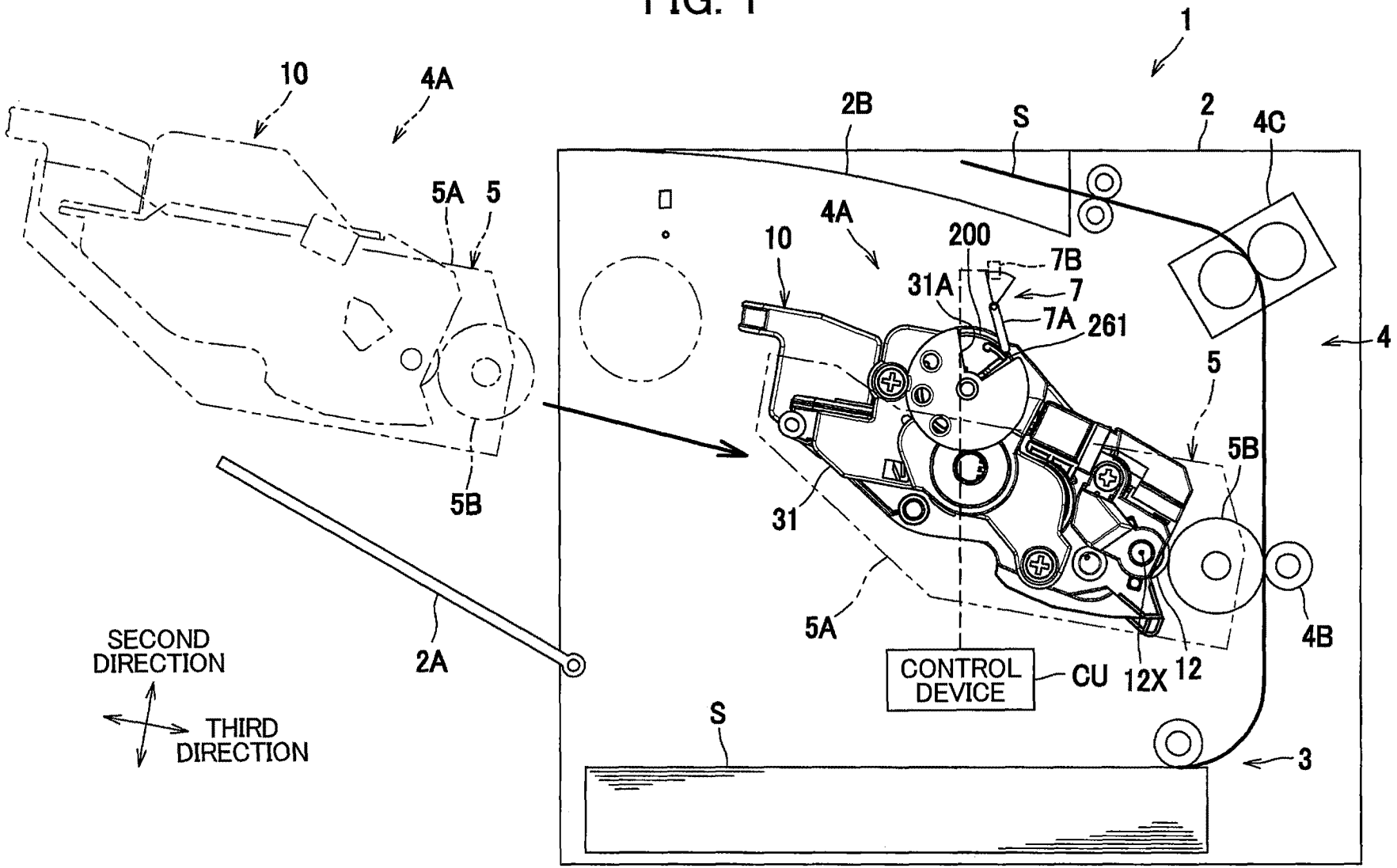
FIG. 1 is a schematic view illustrating a structure of a printer including a developing cartridge according to one embodiment of the present disclosure.

As illustrated in FIG. 1, a laser printer 1 mainly includes a main body casing 2, a sheet-feeding unit 3, an image-forming unit 4, and a control device CU.

The main body casing 2 includes a front cover 2A and a discharge tray 2B positioned at an upper portion of the main body casing 2. The main body casing 2 has therein the sheet-feeding unit 3 and the image-forming unit 4. By opening the front cover 2A, a developing cartridge 10 can be detached from and attached to the main body casing 2.

The sheet-feeding unit 3 accommodates sheets S. The sheet-feeding unit 3 feeds the sheets S one by one to the image-forming unit 4.

The image-forming unit 4 includes a process cartridge 4A, an exposure unit (not illustrated), a transfer roller 4B, and a fixing device 4C.

The process cartridge 4A includes a drum cartridge 5 and the developing cartridge 10. The developing cartridge 10 can be attached to and detached from the drum cartridge 5. In a state where the developing cartridge 10 is attached to the drum cartridge 5, the developing cartridge 10 is attached to and detached from the laser printer 1 as the process cartridge 4A. The drum cartridge 5 includes a frame 5A and a photosensitive drum 5B rotatably supported by the frame 5A.

Figure 2:
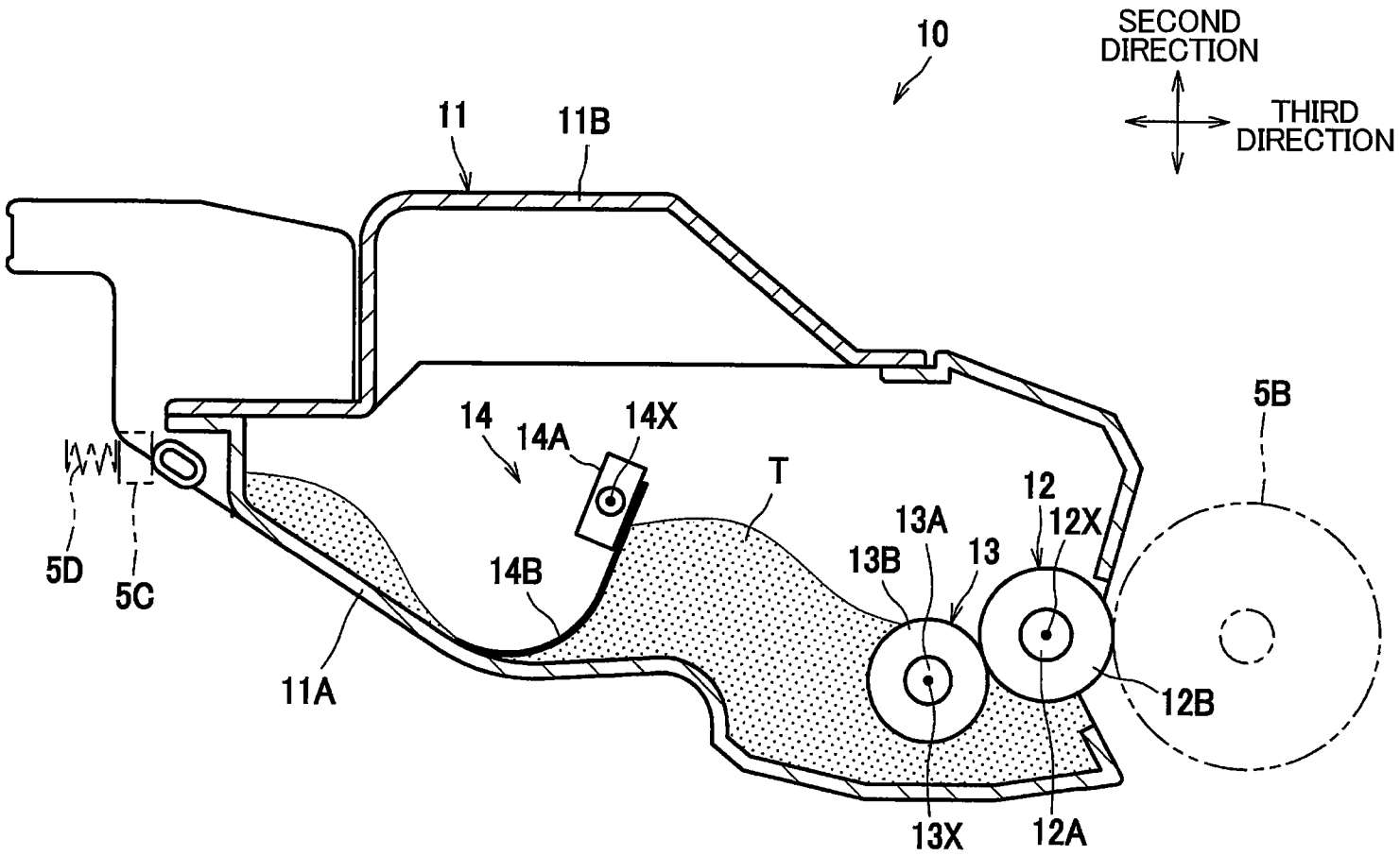
FIG. 2 is a cross-sectional view illustrating a structure of a casing of the developing cartridge.

As illustrated in FIG. 2, the developing cartridge 10 includes a casing 11, a developing roller 12, a supply roller 13, and an agitator 14.

The casing 11 includes a container 11A and a cover 11B. The container 11A of the casing 11 can accommodate therein toner T. The toner T is an example of developing agent.

The developing roller 12 includes: a developing-roller shaft 12A extending in a first direction; and a roller portion 12B. Here, the first direction is an axial direction of the developing roller 12 and hereinafter sometimes referred to simply as "axial direction". The roller portion 12B covers an outer circumferential surface of the developing-roller shaft 12A. The roller portion 12B is made of an electrically conductive rubber or the like. The developing roller 12 is rotatable about the developing-roller shaft 12A. In other words, the developing roller 12 is rotatable about a first axis 12X extending in the axial direction. The developing roller 12 is supported by the casing 11 so as to be rotatable about the developing-roller shaft 12A. That is, the roller portion 12B is rotatable together with the developing-roller shaft 12A. Developing bias is applied to the developing roller 12 from the control device CU.

The container 11A and the cover 11B of the casing 11 face each other in a second direction. The second direction crosses the first direction. Preferably, the second direction is orthogonal to the first direction. The developing roller 12 is positioned at one end portion of the casing 11 in a third direction. The third direction crosses both the first direction and the second direction. Preferably, the third direction is orthogonal to both the first direction and the second direction.

The supply roller 13 includes: a supply-roller shaft 13A extending in the first direction; and a roller portion 13B. The roller portion 13B covers an outer circumferential surface of the supply-roller shaft 13A. The roller portion 13B is made of sponge or the like. The supply roller 13 is rotatable about the supply-roller shaft 13A. In other words, the supply roller 13 is rotatable about a third axis 13X extending in the axial direction. The roller portion 13B is rotatable together with the supply-roller shaft 13A.

The agitator 14 includes an agitator shaft 14A and a flexible sheet 14B. The agitator shaft 14A is rotatable about a fourth axis 14X extending in the first direction. The agitator shaft 14A is supported by the casing 11 so as to be rotatable about the fourth axis 14X. The agitator 14 is rotatable together with a coupling 22 described later. A base end of the flexible sheet 14B is fixed to the agitator shaft 14A, and a free end of the flexible sheet 14B is configured to contact an inner surface of the casing 11. The agitator 14 can agitate toner T by rotation of the flexible sheet 14B.

The drum cartridge 5 further includes a pressure member 5C and an urging member 5D. The pressure member 5C is configured to press the developing roller 12 against the photosensitive drum 5B. The urging member 5D is configured to urge the pressure member 5C toward the photosensitive drum 5B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure unit (not illustrated), so that an electrostatic latent image is formed on the photosensitive drum 5B. The developing cartridge 10 supplies toner T to the latent image to form a toner image on the photosensitive drum 5B. In a process in which the sheet S that has been fed from the sheet-feeding unit 3 passes between the photosensitive drum 5B and the transfer roller 4B, the toner image on the photosensitive drum 5B is transferred onto the sheet S.

The fixing device 4C is configured to thermally fix the toner image transferred onto the sheet S to the sheet S. The sheet S to which the toner image has been thermally fixed is discharged onto the discharge tray 2B outside the main body casing 2.

The control device CU is a device configured to control the overall operations of the laser printer 1.

The laser printer 1 further includes a sensor 7. The sensor 7 is a sensor for detecting whether or not the developing cartridge 10 is a new developing cartridge or identifying the specification of the developing cartridge 10. The sensor 7 includes: a lever 7A pivotably supported by the main body casing 2; and an optical sensor 7B. The lever 7A is positioned at a position where the lever 7A can contact a protrusion and the like that are rotatable together with a detection gear 200 described later. The optical sensor 7B is connected to the control device CU and outputs detection signals to the control device CU. The control device CU is configured to determine the specification and the like of the developing cartridge 10 on a basis of the signals received from the optical sensor 7B. The optical sensor 7B detects displacement of the lever 7A and transmits the detection signals to the control device CU. More specifically, for example, a sensor unit that includes a light-emitting portion and a light-receiving portion is employed as the optical sensor 7B.

Figure 3:
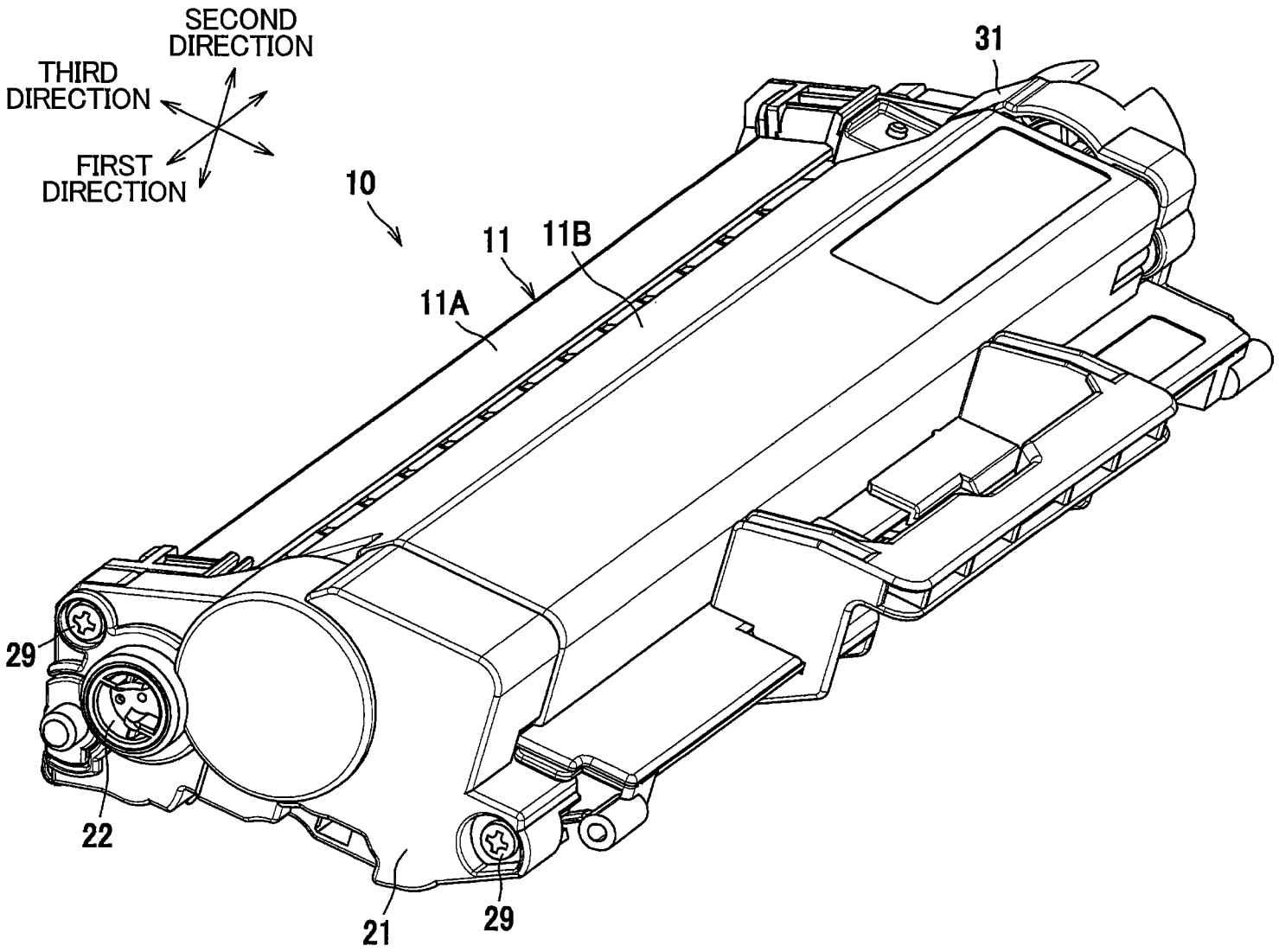
FIG. 3 is a perspective view illustrating one side portion of the developing cartridge in a first direction.
Figure 4:
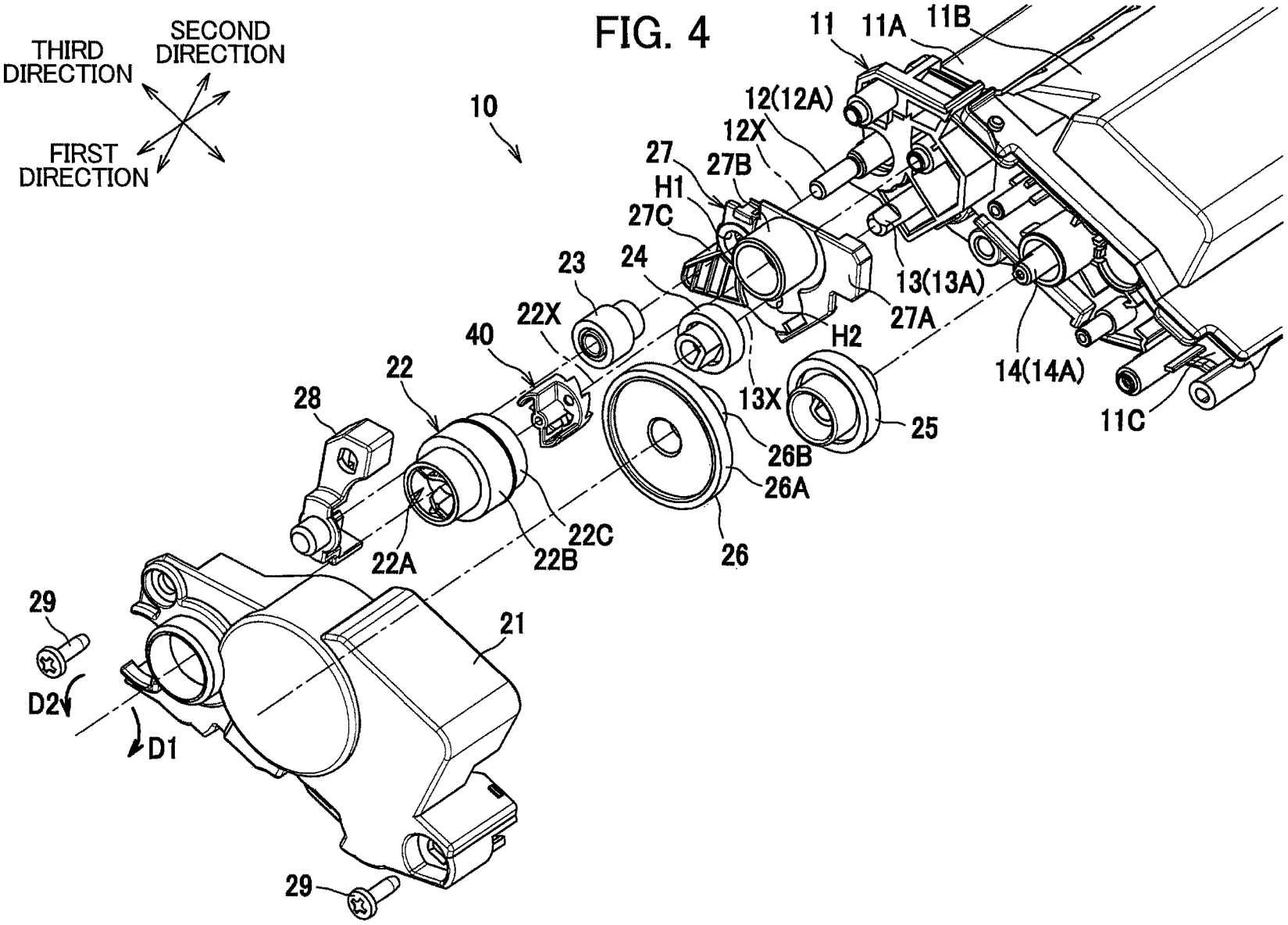
FIG. 4 is an exploded perspective view illustrating components positioned at one side portion of the casing in the first direction.

Next, the structure of the developing cartridge 10 will be described in detail. As illustrated in FIGS. 3 and 4, the developing cartridge 10 includes, at one side portion of the casing 11 in the first direction, a first gear cover 21, the coupling 22, a developing gear 23, a supply gear 24, a first agitator gear 25, an idle gear 26, a first bearing member 27 as an example of a bearing member, a clutch 40, and a cap 28.

The first gear cover 21 supports the idle gear 26 by a shaft (not illustrated) and covers at least one of the gears positioned at the one side portion of the casing 11. The first gear cover 21 is fixed to an outer surface 11C by screws 29. The outer surface 11C is an outer surface positioned on the one side portion of the casing 11 in the first direction.

Note that, the term "gear" in the present specification is not limited to a member that includes gear teeth and transmits rotational force through the gear teeth, but also includes a member that transmits rotational force through friction. In the latter case, rubber and the like are used instead of gear teeth. In a case where the member that transmits rotational force through friction is employed, a circle passing along the friction-transmitting surface (a surface of the rubber is the friction-transmitting surface in a case where rubber is used instead of gear teeth) is defined as an addendum circle.

The coupling 22 is a member for rotating the developing roller 12 and the like. The coupling 22 is rotatable about a second axis 22X extending in the axial direction. The coupling 22 is positioned at the one side portion of the casing 11 in the first direction. That is, the coupling 22 is positioned at the outer surface 11C. The coupling 22 can rotate in a first rotational direction D1 by receiving driving force. Specifically, the coupling 22 can receive driving force from the laser printer 1. The coupling 22 can rotate by engaging with a drive member (not illustrated) provided in the laser printer 1. The coupling 22 includes a first recessed portion 22A at one end of the coupling 22 in the axial direction. The first recessed portion 22A is recessed in the first direction. The first recessed portion 22A can receive and engage with the drive member. More specifically, the first recessed portion 22A can engage with the drive member of the laser printer 1 and receive the driving force from the drive member.

The coupling 22 includes: a first gear 22B in meshing engagement with the developing gear 23; and a second gear 22C in meshing engagement with the supply gear 24. A diameter of the first gear 22B is different from a diameter of the second gear 22C. Specifically, the diameter of the first gear 22B is greater than the diameter of the second gear 22C.

The developing gear 23 is attached to the developing-roller shaft 12A. The developing gear 23 is rotatable together with the developing roller 12 about the first axis 12X. The developing gear 23 is positioned at the one side portion of the casing 11 in the first direction. That is, the developing gear 23 is positioned at the outer surface 11C.

The supply gear 24 is attached to the supply-roller shaft 13A. The supply gear 24 is rotatable together with the supply roller 13 about the third axis 13X. The supply gear 24 is positioned at the one side portion of the casing 11 in the first direction. That is, the supply gear 24 is positioned at the outer surface 11C.

The first agitator gear 25 is positioned at the one side portion of the casing 11 in the first direction. That is, the first agitator gear 25 is positioned at the outer surface 11C. The first agitator gear 25 is attached to the agitator shaft 14A of the agitator 14. The first agitator gear 25 is rotatable together with the agitator 14 in accordance with rotation of the coupling 22.

The idle gear 26 is positioned at the one side portion of the casing 11 in the first direction. That is, the idle gear 26 is positioned at the outer surface 11C. The idle gear 26 includes: a large-diameter portion 26A in meshing engagement with the first gear 22B of the coupling 22; and a small-diameter portion 26B in meshing engagement with the gear teeth of the first agitator gear 25. The idle gear 26 is rotatably supported by the shaft (not illustrated) of the first gear cover 21. The idle gear 26 decelerates rotation of the coupling 22 and transmits the decelerated rotation to the first agitator gear 25. The large-diameter portion 26A is positioned farther from the casing 11 in the first direction than the small-diameter portion 26B is from the casing 11 in the first direction.

The cap 28 covers one end of the developing-roller shaft 12A which is at the one side in the first direction. Note that the first gear cover 21 and the cap 28 may be made of different kinds of resin.

The first bearing member 27 rotatably supports the coupling 22, the clutch 40, the developing gear 23, and the supply gear 24. The first bearing member 27 is fixed to the one side portion of the casing 11 in the first direction. The first bearing member 27 includes a base portion 27A, a shaft 27B, and a developing agent receiving portion 27C. The shaft 27B protrudes from the base portion 27A toward the one side in the first direction. The developing agent receiving portion 27C protrudes toward the other side in the first direction from one end portion of the base portion 27A which is at one side in the third direction.

The base portion 27A has a first hole H1 and a second hole H2. The developing roller shaft 12A which is a rotation shaft of the developing roller 12 is inserted through the first hole H1. The supply-roller shaft 13A is inserted through the second hole H2. The first hole H1 is an example of a hole.

The shaft 27B has a hollow cylindrical shape. The shaft 27B rotatably supports the coupling 22 and the clutch 40. Specifically, an outer circumferential surface B11 (see FIG. 6) of the shaft 27B rotatably supports the coupling 22. An inner circumferential surface B12 (see FIG. 6) of the shaft 27B rotatably supports the clutch 40. More specifically, the shaft 27B has a hole B13 (see FIG. 6). The hole B13 is a recess recessed in the axial direction or a through-hole extending in the axial direction. The clutch 40 is positioned in the hole B13. Accordingly, the clutch 40 rotates along the inner circumferential surface B12 of the hole B13. That is, the clutch 40 is rotatable together with the coupling 22 relative to the shaft 27B.

Figure 6:
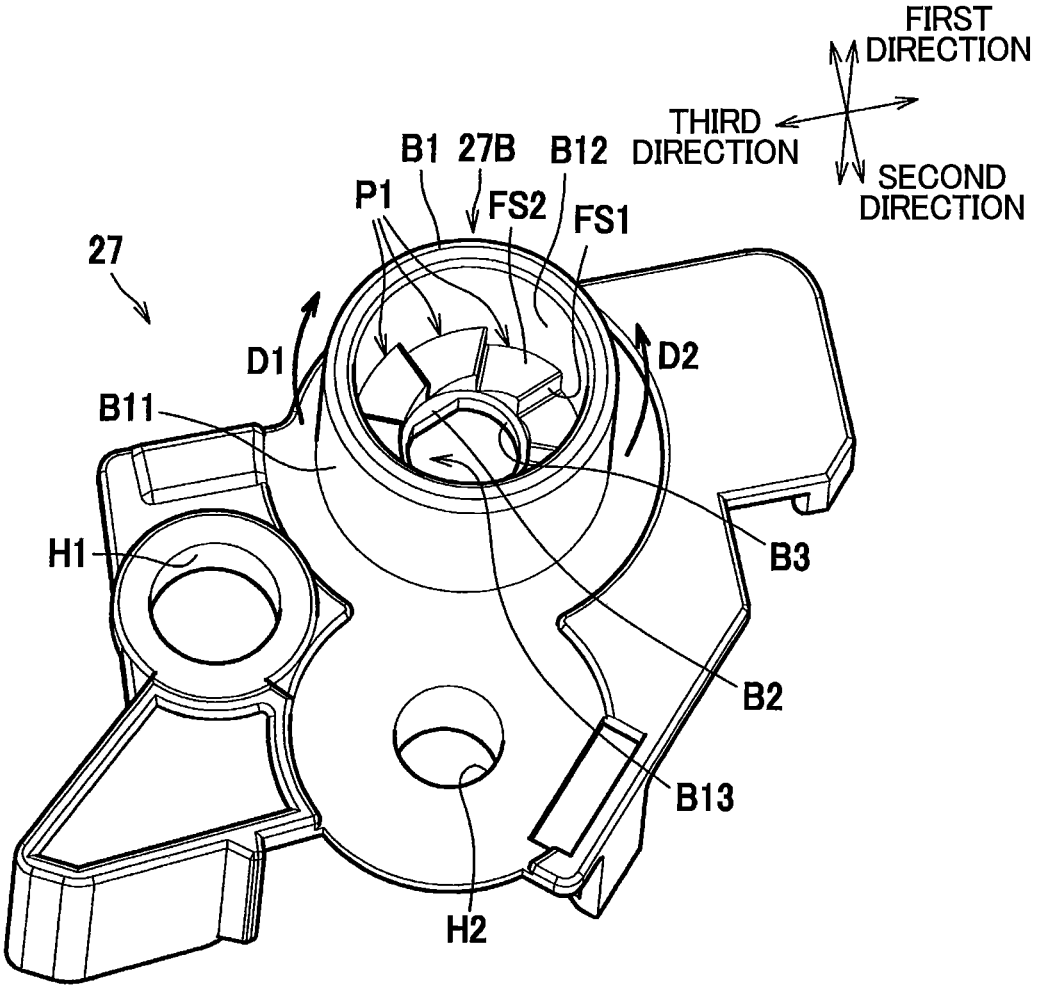
FIG. 6 is a perspective view of a first bearing member as viewed from one side in the first direction.
Figure 9A:
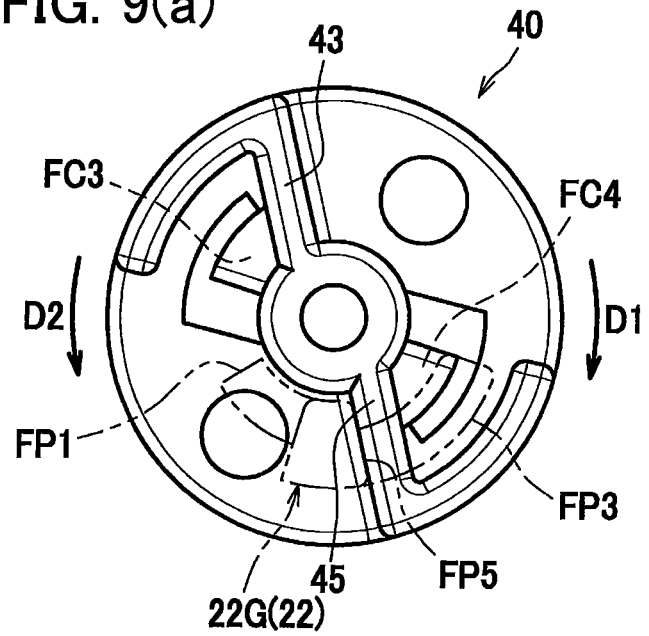
FIGS. 9(*a*) is a view illustrating positional relationship among portions of the coupling, the clutch, and a shaft when the clutch is positioned at a first position.
Figure 9B:
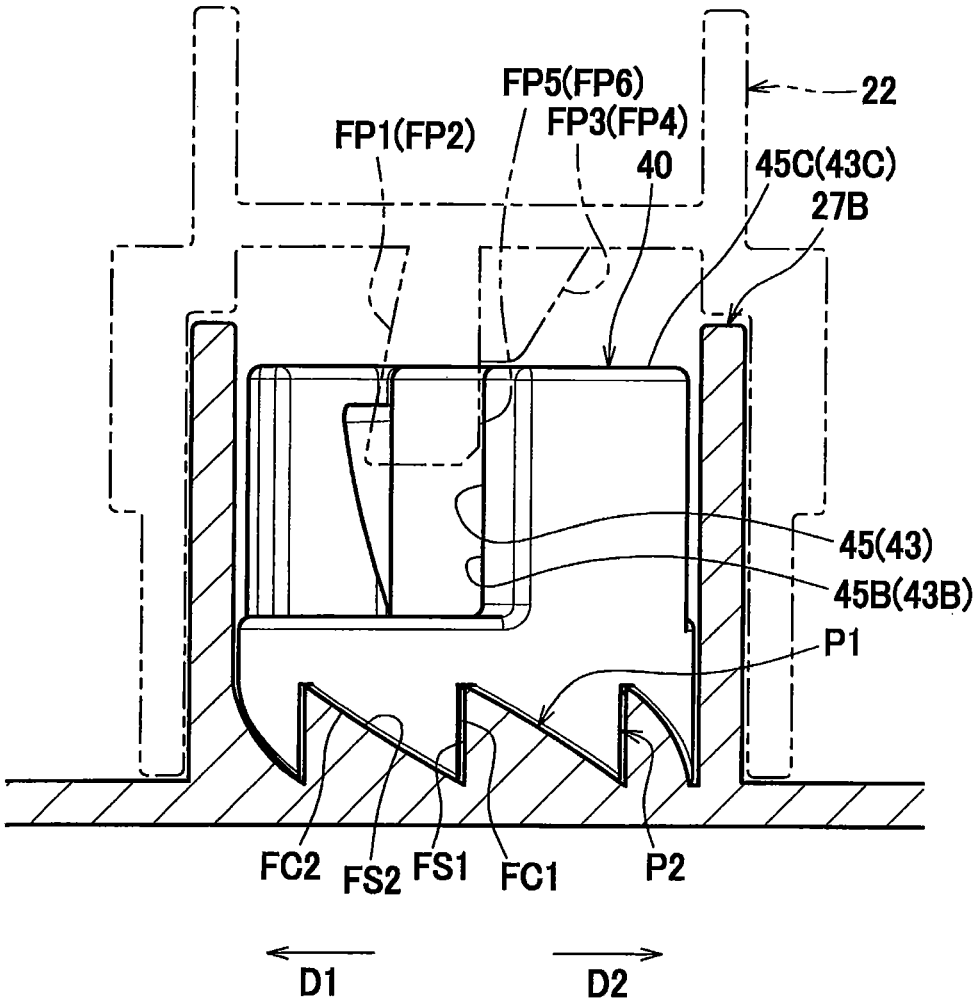
Figure 10A:
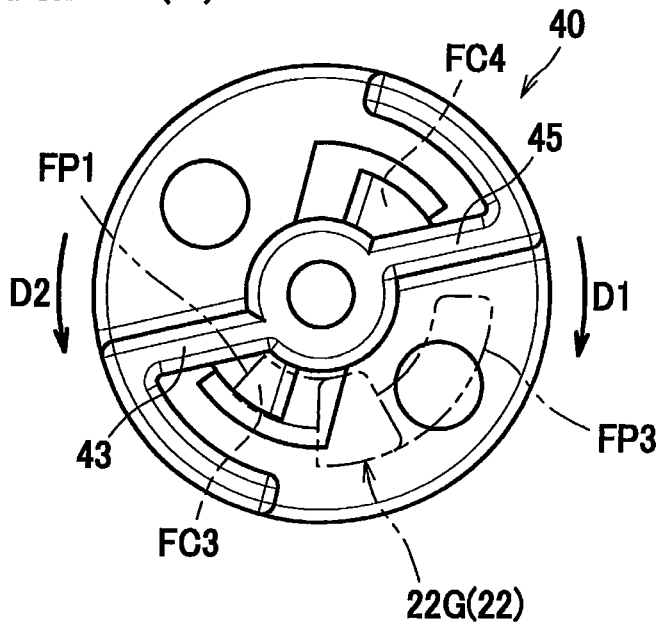
FIG. 10(*a*) is a view illustrating the positional relationship among the portions of the coupling, the clutch, and the shaft when the clutch is positioned at a second position.
Figure 10B:
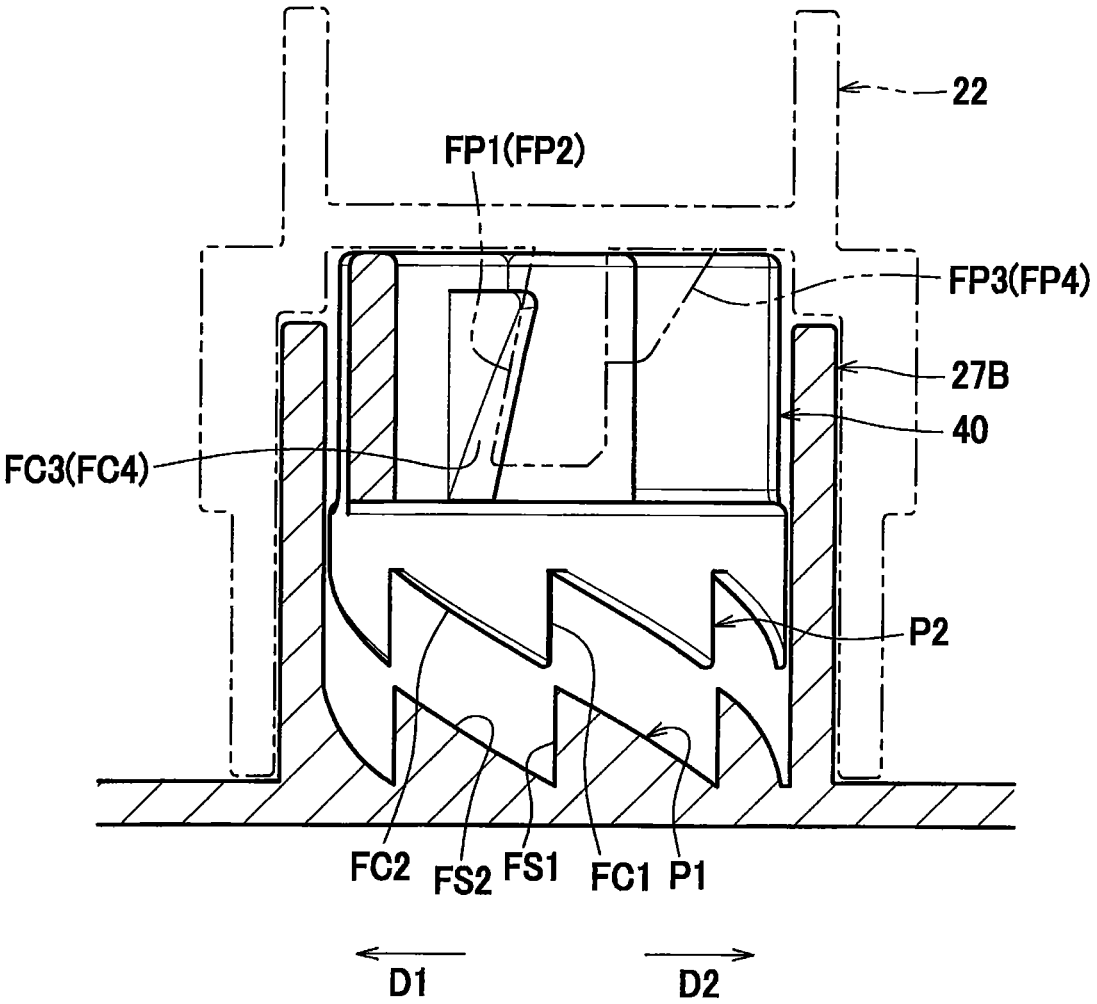

The clutch 40 has a function of allowing rotation of the coupling 22 in the first rotational direction D1 (clockwise direction in FIG. 6). Further, the clutch 40 has a function of stopping rotation of the coupling 22 in a second rotational direction D2 opposite to the first rotational direction D1. Specifically, as illustrated in FIGS. 9 to 10, the clutch 40 is rotatable together with the coupling 22 and is movable relative to the shaft 27B in the axial direction. The clutch 40 is movable between: a first position where the clutch 40 engages with a portion (first protrusions P1 described later) of the shaft 27B in the rotational direction; and a second position where the clutch 40 is disengaged from the portion of the shaft 27B. In other words, the clutch 40 is movable between: the first position where the clutch 40 engages with the portion of the shaft 27B; and the second position where the clutch 40 is spaced away from the portion of the shaft 27B in the axial direction.

In a case where the coupling 22 rotates in the first rotational direction D1, the clutch 40 is positioned at the second position and thus the coupling 22 rotates together with the clutch 40. On the other hand, in a case where the coupling 22 rotates in the second rotational direction D2, the clutch 40 moves to the first position and thus engages with the portion of the shaft 27B. By this, the rotation of the clutch 40 is stopped by the portion of the shaft 27B, so that the coupling 22 rotating together with the clutch 40 does not rotate in the second rotational direction D2 any further.

Note that the coupling 22 does not move relative to the shaft 27B in a direction away from the outer surface 11C of the casing 11 since the coupling 22 contacts the first gear cover 21. Here, "the coupling 22 does not move relative to the shaft 27B" denotes not only that the coupling is completely immovable but also that the coupling 22 slightly moves due to looseness. The clutch 40 is movable relative to the coupling 22 in the axial direction.

Figure 5:
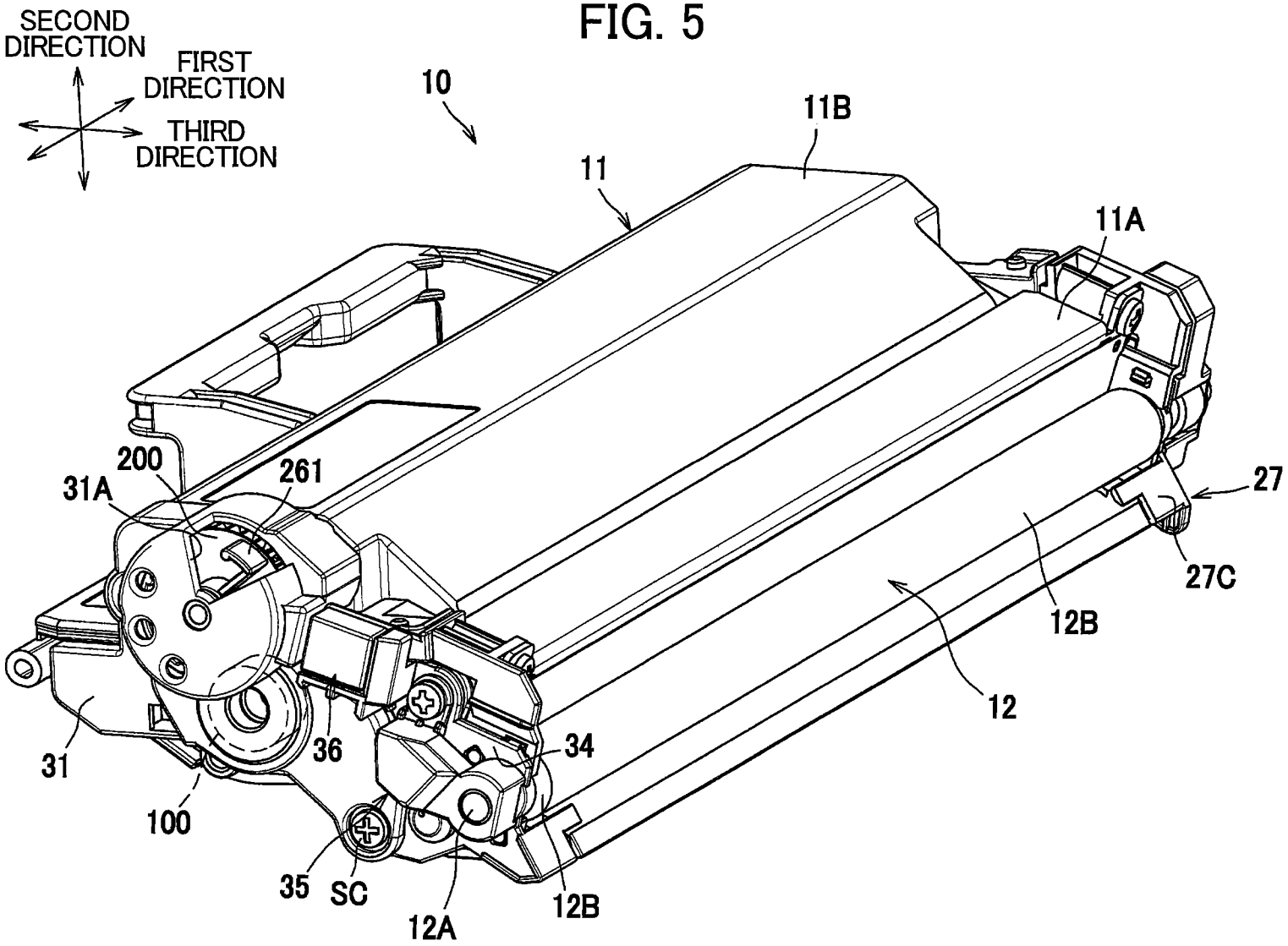
FIG. 5 is a perspective view illustrating the other side portion of the developing cartridge in the first direction.

As illustrated in FIG. 5, the developing agent receiving portion 27C is positioned at an end portion of the developing roller 12 in the axial direction. Specifically, the developing agent receiving portion 27C is positioned at an end portion in the axial direction of the roller portion 12B of the developing roller 12. The developing agent receiving portion 27C has a V-shaped cross-section taken along a plane orthogonal to the axial direction.

The developing cartridge 10 includes, at the other side portion of the casing 11 in the first direction, a second gear cover 31, a second agitator gear 100, the detection gear 200, a second bearing member 34, a developing electrode 35, and a supply electrode 36.

The second gear cover 31 is a cover covering at least a portion of the detection gear 200. The second gear cover 31 is positioned at an outer surface of the container 11A of the casing 11, the outer surface being at the other side in the first direction. The second gear cover 31 has an opening 31A. By the opening 31A, a portion of the detection gear 200 is exposed.

The second agitator gear 100 is positioned at the other side portion of the casing 11 in the first direction. That is, the second agitator gear 100 is positioned at the outer surface of the container 11A of the casing 11, the outer surface being at the other side in the first direction. The second agitator gear 100 is attached to the agitator shaft 14A (see FIG. 2). Accordingly, the second agitator gear 100 is rotatable together with the agitator shaft 14A of the agitator 14 about the fourth axis 14X extending in the axial direction.

The detection gear 200 is positioned at the other side portion of the casing 11 in the first direction. The detection gear 200 is rotatable together with the second agitator gear 100 when the detection gear 200 engages with the second agitator gear 100.

The detection gear 200 includes a plurality of detection protrusions 261 which can contact the lever 7A (see FIG. 1) of the sensor 7. Note that, by changing the number of the detection protrusions 261 and the positions of the detection protrusions 261 in accordance with the specification of the developing cartridge 10, the developing cartridges 10 of various specifications can be identified by the control device CU.

The second bearing member 34 rotatably supports the developing-roller shaft 12A and the supply-roller shaft 13A. In a state where the second bearing member 34 supports the developing-roller shaft 12A and the supply-roller shaft 13A, the second bearing member 34 is fixed to the outer surface of the container 11A of the casing 11, the outer surface being at the other side in the first direction.

The developing electrode 35 is positioned at the other side portion of the casing 11 in the first direction. The developing electrode 35 supplies electric power to the developing-roller shaft 12A. The developing electrode 35 is made of electrically conductive resin, for example.

The supply electrode 36 is positioned at the other side portion of the casing 11 in the first direction. The supply electrode 36 supplies electric power to the supply-roller shaft 13A. The supply electrode 36 is made of electrically conductive resin, for example.

Together with the second bearing member 34, the developing electrode 35 and the supply electrode 36 are fixed by screws 38 to an outer surface positioned at the other side portion of the casing 11 in the first direction.

As illustrated in FIG. 6, the shaft 27B includes a hollow cylindrical wall B1, a bottom wall portion B2, and the plurality of first protrusions P1. The hollow cylindrical wall B1 has a hollow cylindrical shape. The hollow cylindrical wall B1 has the outer circumferential surface B11 and the inner circumferential surface B12. The bottom wall portion B2 is positioned at one end portion of the hollow cylindrical wall B1 in the axial direction. The bottom wall portion B2 has a disc-like shape. The bottom wall portion B2 has a hole B3. The hole B3 penetrates the center portion of the bottom wall portion B2 in the first direction.

The plurality of first protrusions P1 protrude from the bottom wall portion B2 toward the other end portion in the axial direction of the hollow cylindrical wall B1. The plurality of first protrusions P1 are arranged in the rotational direction of the coupling 22. The plurality of first protrusions P1 are arranged in an annular fashion. The plurality of first protrusions P1 are positioned in the hole B13 defined by the hollow cylindrical wall B1. The plurality of first protrusions P1 are positioned at the one end portion of the hollow cylindrical wall B1 in the axial direction. Each of the first protrusions P1 has: a first shaft surface FS1 along the first direction; and a second shaft surface FS2 inclined relative to the first direction.

The first shaft surface FS1 is a surface for stopping rotation of the clutch 40 in the second rotational direction D2. The first shaft surface FS1 crosses the rotational direction of the clutch 40. Preferably, the first shaft surface FS1 is orthogonal to the rotational direction of the clutch 40. In a case where the clutch 40 rotates in the second rotational direction D2, the first shaft surface FS1 faces and contacts the clutch 40 (specifically, a first clutch surface FC1 described later; see FIG. 7) in the second rotational direction D2.

The second shaft surface FS2 is a surface for moving the clutch 40 from the first position toward the second position in a case where the clutch 40 rotates in the first rotational direction D1. The second shaft surface FS2 is inclined relative to the rotational direction of the clutch 40. Specifically, the second shaft surface FS2 is inclined so as to approach the other end portion in the axial direction of the hollow cylindrical wall B1 as it goes in the first rotational direction D1.

Figure 7A:
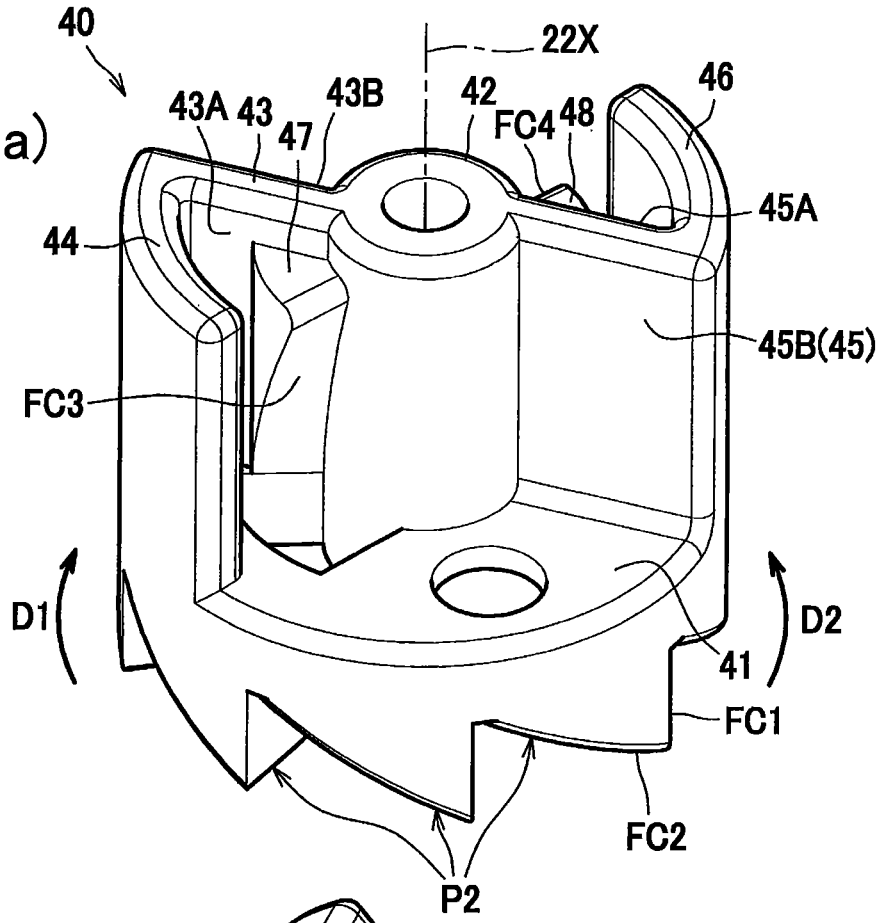
FIG. 7(*a*) is a perspective view illustrating a clutch as viewed from the one side in the first direction.
Figure 7B:
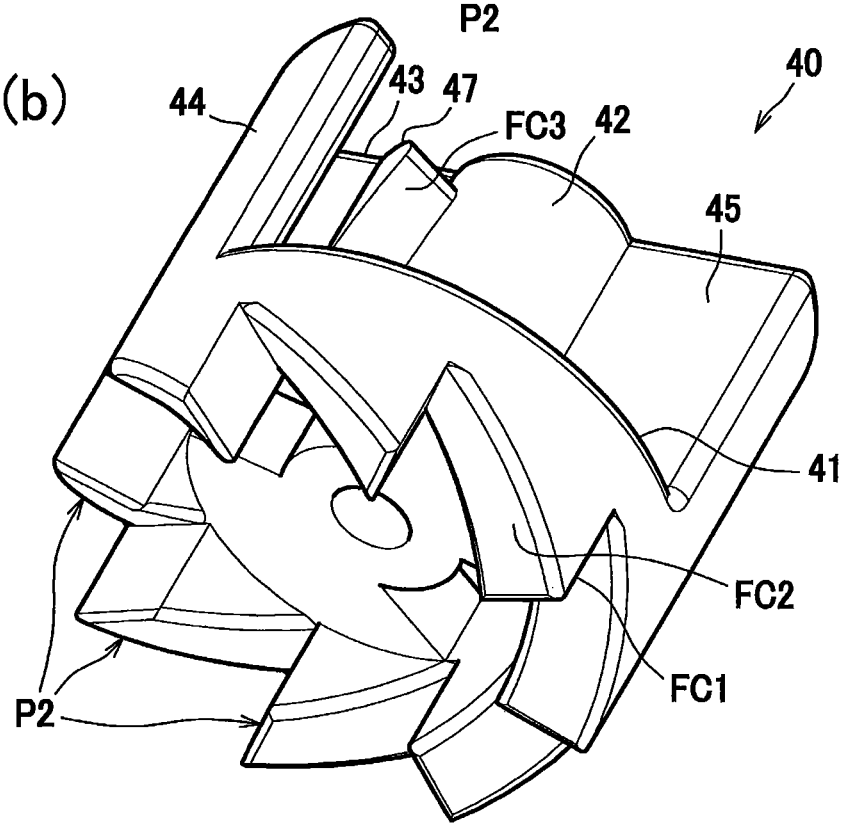
Figure 8A:
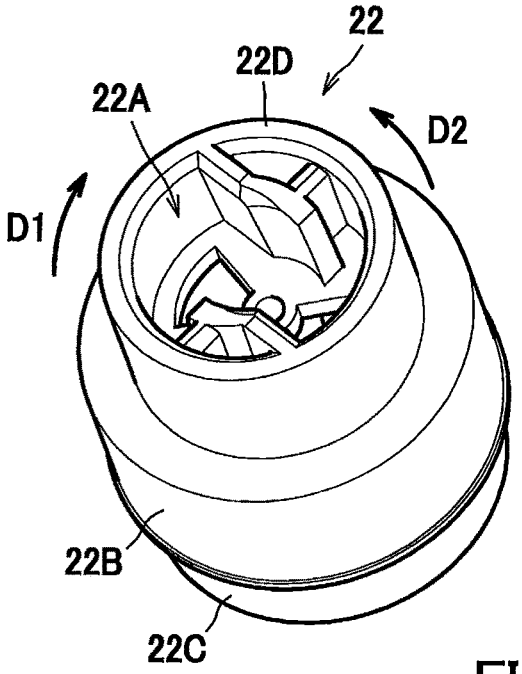
FIG. 8(*a*) is a perspective view illustrating a coupling as viewed from the one side in the first direction.
Figure 8B:
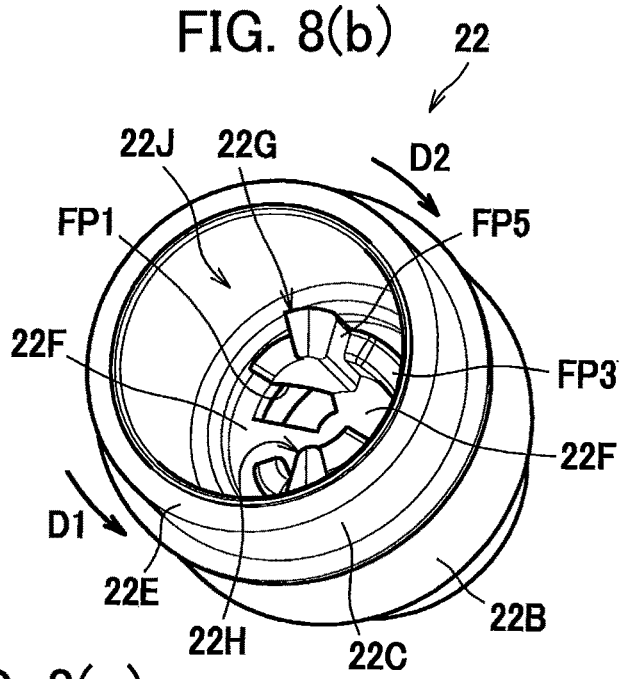
Figure 8C:
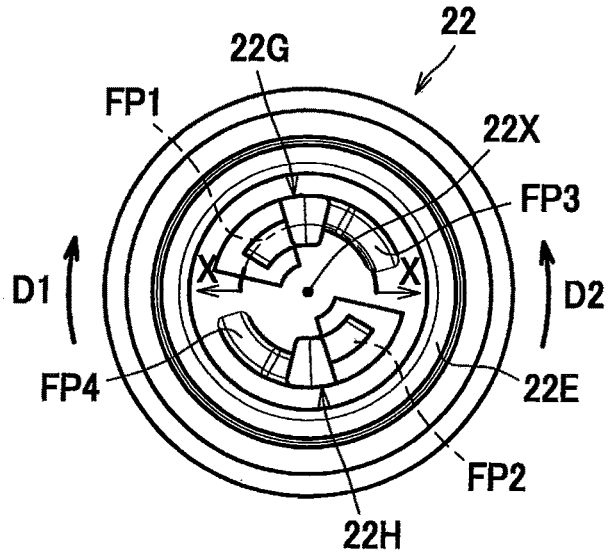
Figure 8D:
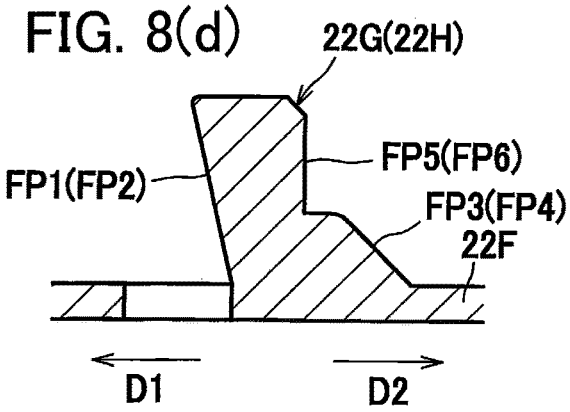

As illustrated in FIGS. 7(*a*) and 7(*b*), the clutch 40 includes: a base portion 41 having a disc-like shape; a plurality of second protrusions P2; a shaft portion 42; a first wall 43; a first arc wall 44; a second wall 45; and a second arc wall 46. The plurality of second protrusions P2 protrude from one surface of the base portion 41, the one surface being at one side in the axial direction of the clutch 40. The shaft portion 42, the first wall 43, the first arc wall 44, the second wall 45, and the second arc wall 46 protrude from the other surface of the base portion 41, the other surface being at the other side in the axial direction of the clutch 40.

The plurality of second protrusions P2 are arranged in the rotational direction of the coupling 22. The plurality of second protrusions P2 are arranged in an annular fashion. Each of the second protrusions P2 has a first clutch surface FC1 and a second clutch surface FC2. The first clutch surface FC1 is along the first direction. The second clutch surface FC2 is inclined relative to the first direction.

The first clutch surface FC1 is a surface for stopping rotation of the clutch 40 in the second rotational direction D2. The first clutch surface FC1 crosses the rotational direction of the clutch 40. Preferably, the first clutch surface FC1 is orthogonal to the rotational direction of the clutch 40. The first clutch surface FC1 is configured to contact the first shaft surface FS1 (see FIG. 6). Specifically, the first clutch surface FC1 is configured to surface-contact the first shaft surface FS1.

The second clutch surface FC2 is a surface for moving the clutch 40 from the first position toward the second position in a case where the clutch 40 rotates in the first rotational direction D1. The second clutch surface FC2 is inclined relative to the rotational direction of the clutch 40. Specifically, the second clutch surface FC2 is inclined so as to approach the base portion 41 as it goes in the first rotational direction D1. The second clutch surface FC2 is configured to contact the second shaft surface FS2 (see FIG. 6). Specifically, the second clutch surface FC2 is configured to surface-contact the second shaft surface FS2.

The shaft portion 42 extends from the center portion of the base portion 41 toward the other side in the axial direction of the clutch 40. The shaft portion 42 has a hollow cylindrical shape.

The first wall 43 extends radially outwardly from the shaft portion 42. The first wall 43 has a first surface 43A and a second surface 43B. The first surface 43A and the second surface 43B are orthogonal to the rotational direction. The first surface 43A is directed downstream in the second rotational direction D2. The second surface 43B is directed upstream in the second rotational direction D2. The first surface 43A has a third protrusion 47. The third protrusion 47 protrudes from the first surface 43A. The third protrusion 47 extends along an outer circumferential surface of the shaft portion 42. The third protrusion 47 has a third clutch surface FC3.

The third clutch surface FC3 is a surface for moving the clutch 40 from the first position toward the second position in a case where the coupling 22 rotates in the first rotational direction D1. The third clutch surface FC3 is inclined relative to the rotational direction of the clutch 40. Specifically, the third clutch surface FC3 is inclined so as to approach the base portion 41 as it goes in the first rotational direction D1. In a case where the coupling 22 rotates in the first rotational direction D1, the third clutch surface FC3 contacts a coupling surface FP1 described later (see FIG. 10(*b*)).

The first arc wall 44 extends in the second rotational direction D2 from a radially outer end portion of the first wall 43. The first arc wall 44 has an arc shape whose center is the second axis 22X. An outer circumferential surface of the first arc wall 44 and an outer circumferential surface of the base portion 41 are flush with each other. The outer circumferential surface of the first arc wall 44 and the outer circumferential surface of the base portion 41 are rotatably supported by the inner circumferential surface B12 (see FIG. 6) of the shaft 27B. Specifically, the outer circumferential surface of the first arc wall 44 and the outer circumferential surface of the base portion 41 are cylindrical surfaces whose center is the second axis 22X. Also, the inner circumferential surface B12 is a cylindrical surface whose center is the second axis 22X. The outer circumferential surface of the first arc wall 44 and the outer circumferential surface of the base portion 41 are in surface-contact with the inner circumferential surface B12 of the shaft 27B. Accordingly, the clutch 40 moves in a direction along the second axis 22X while rotating about the second axis 22X.

The second wall 45 is positioned at the opposite side to the first wall 43 relative to the second axis 22X. The second wall 45 extends radially outwardly from the shaft portion 42. The second wall 45 has a third surface 45A and a fourth surface 45B. The third surface 45A and the fourth surface 45B are orthogonal to the rotational direction. The third surface 45A is directed downstream in the second rotational direction D2. The fourth surface 45B is directed upstream in the second rotational direction D2. The third surface 45A has a fourth protrusion 48. The fourth protrusion 48 protrudes from the third surface 45A. The fourth protrusion 48 extends along the outer circumferential surface of the shaft portion 42. The fourth protrusion 48 has a fourth clutch surface FC4.

The fourth clutch surface FC4 is a surface for moving the clutch 40 from the first position toward the second position in a case where the coupling 22 rotates in the first rotational direction D1. The fourth clutch surface FC4 is inclined relative to the rotational direction of the clutch 40. Specifically, the fourth clutch surface FC4 is inclined so as to approach the base portion 41 as it goes in the first rotational direction D1. In a case where the coupling 22 rotates in the first rotational direction D1, the fourth clutch surface FC4 contacts a second coupling surface FP2 described later (see FIGS. 8(*c*) and 8(*d*)). The fourth clutch surface FC4 is positioned at the opposite side to the third clutch surface FC3 relative to the second axis 22X.

The second arc wall 46 protrudes from a radially outer end portion of the second wall 45 in the second rotational direction D2. The second arc wall 46 has an arc shape whose center is the second axis 22X. An outer circumferential surface of the second arc wall 46 and the outer circumferential surface of the base portion 41 are flush with each other. The outer circumferential surface of the second arc wall 46 and the outer circumferential surface of the base portion 41 are rotatably supported by the inner circumferential surface B12 (see FIG. 6) of the shaft 27B. That is, the outer circumferential surface of the second arc wall 46 and the outer circumferential surface of the base portion 41 are in contact with the inner circumferential surface B12 of the shaft 27B.

The coupling 22 further includes a first tubular portion 22D as illustrated in FIG. 8(*a*) and a second tubular portion 22E as illustrated in FIG. 8(*b*). The first tubular portion 22D and the second tubular portion 22E have a hollow cylindrical shape. An outer diameter of the second tubular portion 22E is greater than an outer diameter of the first tubular portion 22D. An inner diameter of the second tubular portion 22E is greater than an inner diameter of the first tubular portion 22D.

The coupling 22 further includes a partitioning wall 22F. The partitioning wall 22F is positioned between the second tubular portion 22E and the first tubular portion 22D. The partitioning wall 22F partitions an inner space of the second tubular portion 22E from an inner space of the first tubular portion 22D. The first tubular portion 22D and the partitioning wall 22F form the first recessed portion 22A. The second tubular portion 22E and the partitioning wall 22F form a second recessed portion 22J. The second tubular portion 22E is fitted with the outer circumferential surface B11 (see FIG. 6) of the shaft 27B and is rotatably supported by the shaft 27B.

The coupling 22 includes a first protruding piece 22G and a second protruding piece 22H. The first protruding piece 22G and the second protruding piece 22H are positioned in the second recessed portion 22J. The first protruding piece 22G and the second protruding piece 22H protrude from the partitioning wall 22F. The first protruding piece 22G has a first coupling surface FP1, a third coupling surface FP3, and a fifth coupling surface FP5.

The first coupling surface FP1 is a surface for moving the clutch 40 from the first position toward the second position in a case where the clutch 40 rotates in the first rotational direction D1. The first coupling surface FP1 is directed downstream in the first rotational direction D1. The first coupling surface FP1 is inclined relative to the rotational direction of the coupling 22. Specifically, as illustrated in FIG. 8(*d*), the first coupling surface FP1 is inclined so as to be away from the partitioning wall 22F as it goes in the first rotational direction D1.

The third coupling surface FP3 is a surface for moving the clutch 40 from the second position toward the first position in a case where the coupling 22 rotates in the second rotational direction D2. The third coupling surface FP3 is directed downstream in the second rotational direction D2. The third coupling surface FP3 is inclined relative to the rotational direction of the coupling 22. Specifically, the third coupling surface FP3 is inclined so as to approach the partitioning wall 22F as it goes in the second rotational direction D2. The third coupling surface FP3 is configured to contact an end portion of the second wall 45 of the clutch 40.

The fifth coupling surface FP5 is a surface which contacts the second wall 45 of the clutch 40 in the rotational direction in a case where the coupling 22 rotates in the second rotational direction D2. The fifth coupling surface FP5 is positioned farther from the partitioning wall 22F than the third coupling surface FP3 is from the partitioning wall 22F. The fifth coupling surface FP5 crosses the rotational direction of the coupling 22. Preferably, the fifth coupling surface FP5 is orthogonal to the rotational direction of the coupling 22.

As illustrated in FIG. 8(*c*), the second protruding piece 22H has a second coupling surface FP2, a fourth coupling surface FP4, and a sixth coupling surface FP6. The second coupling surface FP2 has a shape the same as the shape of the first coupling surface FP1. The fourth coupling surface FP4 has a shape the same as the shape of the third coupling surface FP3. The sixth coupling surface FP6 has a shape the same as the shape of the fifth coupling surface FP5. The second coupling surface FP2 is positioned at the opposite side to the first coupling surface FP1 in a state where the second axis 22X is interposed between the first coupling surface FP1 and the second coupling surface FP2.

The second coupling surface FP2 is a surface for moving the clutch 40 from the first position toward the second position in a case where the clutch 40 rotates in the first rotational direction D1. The second coupling surface FP2 is directed downstream in the first rotational direction D1. The second coupling surface FP2 is inclined relative to the rotational direction of the coupling 22. Specifically, as illustrated in FIG. 8(*d*), the second coupling surface FP2 is inclined so as to be away from the partitioning wall 22F as it goes in the first rotational direction D1.

The fourth coupling surface FP4 is a surface for moving the clutch 40 from the second position toward the first position in a case where the coupling 22 rotates in the second rotational direction D2. The fourth coupling surface FP4 is directed downstream in the second rotational direction D2. The fourth coupling surface FP4 is inclined relative to the rotational direction of the coupling 22. Specifically, the fourth coupling surface FP4 is inclined so as to approach the partitioning wall 22F as it goes in the second rotational direction D2. The fourth coupling surface FP4 is configured to contact an end portion of the first wall 43 of the clutch 40.

The sixth coupling surface FP6 is a surface which contacts the first wall 43 of the clutch 40 in the rotational direction in a case where the coupling 22 rotates in the second rotational direction D2. The sixth coupling surface FP6 is positioned farther from the partitioning wall 22F than the fourth coupling surface FP4 is from the partitioning wall 22F. The sixth coupling surface FP6 crosses the rotational direction of the coupling 22. Preferably, the sixth coupling surface FP6 is orthogonal to the rotational direction of the coupling 22.

Prior to description as to functions of the coupling 22, the clutch 40, and the shaft 27B with reference to FIGS. 9 and 10, lengths of the first coupling surface FP1 and the like in the axial direction will next be described. Note that, in FIGS. 9 and 10, the structures of the coupling 22 and the like are simplified by omitting or breaking away a portion thereof for better understanding of the drawings.

As illustrated in FIG. 10(*b*), lengths of the first coupling surface FP1 and the second coupling surface FP2 in the axial direction are greater than a length of the second shaft surface FS2 in the axial direction, respectively. By this configuration, in a case where the clutch 40 is positioned at the second position, each tip end of the second protrusions P2 of the clutch 40 can be positioned spaced away from each tip end of the first protrusions P1 of the shaft 27B in the axial direction.

Further, lengths of the third coupling surface FP3 and the fourth coupling surface FP4 in the axial direction are greater than the length of the second shaft surface FS2 in the axial direction, respectively. This configuration can increase amounts of meshing engagement between the second protrusions P2 of the clutch 40 and the first protrusions P1 of the shaft 27B in a case where the clutch 40 is positioned at the first position.

Further, the lengths of the first coupling surface FP1 and the second coupling surface FP2 in the axial direction are greater than the lengths of the third coupling surface FP3 and the fourth coupling surface FP4 in the axial direction, respectively.

Next, functions of the coupling 22, the clutch 40, and the shaft 27B will be described. In the following description, functions of the coupling 22, the clutch 40, and the shaft 27B in a state where the developing cartridge 10 is attached to the drum cartridge 5 will be described. That is, functions of the components in a case where the coupling 22 rotates in the first rotational direction D1 or the second rotational direction D2 in a state where the developing roller 12 is pressed against the photosensitive drum 5B by the pressure member 5C will be described.

As illustrated in FIGS. 9(*a*) and 9(*b*), in a case where the clutch 40 is positioned at the first position, the fifth coupling surface FP5 and the sixth coupling surface FP6 of the coupling 22 engage with the fourth surface 45B of the second wall 45 and the second surface 43B of the first wall 43 of the clutch 40 in the rotational direction, respectively. Further, the first clutch surfaces FC1 of the clutch 40 engage with the first shaft surfaces FS1 of the shaft 27B in the rotational direction, respectively. Hence, in this state, even if the coupling 22 is urged to rotate in the second rotational direction D2, the coupling 22 does not rotate in the second rotational direction D2 by the engagement between the fifth coupling surface FP5 and the fourth surface 45B and the engagement between the sixth coupling surface FP6 and the second surface 43B. Accordingly, the reverse rotation of the developing roller 12 can be suppressed.

Note that, there is known an image forming apparatus capable of performing duplex printing. In this image forming apparatus, for performing duplex printing, an image is formed on the front side of a sheet at an image forming unit and then the front and back sides of the sheet is reversed. Thereafter, the sheet is returned to a position upstream of the image forming unit and then an image is formed on the back side of the sheet. In such an image forming apparatus, there is a case where the photosensitive drum is rotated in a predetermined direction at a time of forming an image on a sheet, whereas the photosensitive drum is rotated in the reverse direction opposite to the predetermined direction at a time of reversing the front and back sides of the sheet. In such a case, the developing roller may rotate in the reverse direction following the photosensitive drum rotating in the reversing direction. Even in such a case, the reverse rotation of the developing roller can be stopped by the structure according to the present embodiment. Specifically, in the present embodiment, if the developing roller 12 rotates in the reverse direction, the coupling 22 in meshing engagement with the developing gear 23 rotates in the second rotational direction D2. However, this rotation of the coupling 22 can be stopped by the clutch 40 whose rotation is stopped by engagement between the protrusions P1 and the protrusions P2. Accordingly, the reverse rotation of the developing roller 12 can be suppressed.

When the coupling 22 rotates in the first rotational direction D1 by receiving driving force in the state illustrated in FIGS. 9(*a*) and 9(*b*), the first coupling surface FP1 and the second coupling surface FP2 of the coupling 22 push the third clutch surface FC3 and the fourth clutch surface FC4 of the clutch 40 in the first rotational direction D1, respectively. Hence, the clutch 40 rotates together with the coupling 22 in the first rotational direction D1.

When the clutch 40 rotates in the first rotational direction D1, each of the second clutch surfaces FC2 of the second protrusions P2 contacts a corresponding one of the second shaft surfaces FS2 of the first protrusions P1, so that the clutch 40 is pressed toward the one side in the first direction by the second shaft surfaces FS2 to thereby move from the first position to the second position. By this, each of the second protrusions P2 is moved away from a corresponding one of the first protrusions P1 in the axial direction. That is, each of the second protrusions P2 is disengaged from a corresponding one of the first protrusions P1. Then, the first coupling surface FP1 and the second coupling surface FP2 of the coupling 22 press the third clutch surface FC3 and the fourth clutch surface FC4 of the clutch 40 toward the second position, respectively. By this, the clutch 40 is positioned at the second position as illustrated in FIGS. 10(*a*) and 10(*b*). In this state, the second protrusions P2 are positioned spaced away from the first protrusions P1 in the axial direction and thus the rotation of the clutch 40 is not stopped by the first protrusions P1, so that the coupling 22 rotates together with the clutch 40. Accordingly, driving force can be satisfactorily transmitted.

When the coupling 22 rotates in the second rotational direction D2 due to reverse rotation of the photosensitive drum 5B from the state illustrated in FIGS. 10(*a*) and 10(*b*), the third coupling surface FP3 and the fourth coupling surface FP4 of the coupling 22 contact the end portion 45C of the second wall 45 and the end portion 43C of the first wall 43 of the clutch 40, respectively. By this, the clutch 40 is pressed and moved toward the first protrusions P1 by the third coupling surface FP3 and the fourth coupling surface FP4. When the clutch 40 is disengaged from the third coupling surface FP3 and the fourth coupling surface FP4, each of the first clutch surfaces FC1 of the second protrusions P2 contacts a corresponding one of the first shaft surfaces FS1 of the first protrusions P1 as illustrated in FIG. 9(*b*). Thus, the rotation of the clutch 40 in the second rotational direction D2 is stopped by the first shaft surfaces FS1.

Then, when the coupling 22 slightly rotates in the second rotational direction D2, the fifth coupling surface FP5 and the sixth coupling surface FP6 contact the second wall 45 and the first wall 43 of the clutch 40, respectively. Hence, the rotation of the coupling 22 in the second rotational direction D2 is stopped by the walls 43 and 45 of the clutch 40 whose rotation has been stopped by the first shaft surfaces FS1.

Note that, the above-described functions are similarly exhibited in a state where the developing cartridge 10 is detached from the drum cartridge 5.

The following effects can be obtained in the present embodiment. In the above-described embodiment, the clutch 40 rotates together with the coupling 22 in a case where the coupling 22 rotates in the first rotational direction D1. Further, in a case where the coupling 22 is caused to rotate in the second rotational direction D2, the clutch 40 engages with the portion of the shaft 27B and the clutch 40 and the coupling 22 do not rotate. Accordingly, the coupling 22 can be suppressed from rotating of in a reverse rotation (the second rotational direction D2) opposite to a predetermined rotational direction (the first rotational direction D1).

Leakage of toner due to the reverse rotation of the developing roller 12 can be suppressed since the coupling 22 can be suppressed from rotating in the reverse rotational direction (the second rotational direction D2) opposite to the predetermined rotational direction (the first rotational direction D1).

Since each of the first clutch surfaces FC1 of the second protrusions P2 contacts a corresponding one of the first shaft surfaces FS1 of the first protrusions P1 and thus rotations of the coupling 22 and the clutch 40 can be stopped, the rotation of the coupling 22 can be stopped satisfactorily.

The clutch 40 can be moved away from the first protrusions P1 in the axial direction since the lengths of the first coupling surface FP1 and the second coupling surface FP2 in the axial direction are greater than the length of the second shaft surface FS2 in the axial direction, respectively. Hence, the second protrusions P2 of the clutch 40 and the first protrusions P1 of the shaft 27B can be prevented from interfering with each other in a case where the coupling 22 rotates together with the clutch 40 in the first rotational direction D1.

The first coupling surface FP1 and the second coupling surface FP2 are positioned at positions interposing the second axis 22X between the first coupling surface FP1 and the second coupling surface FP2. Therefore, the clutch 40 can be pressed toward the second position in a well-balanced manner by the coupling surfaces FP1 and FP2, so that the clutch 40 can be smoothly moved to the second position. That is, according to the present embodiment, the clutch 40 can be smoothly moved toward the second position by the two coupling surfaces FP1 and FP2 positioned in a state where the second axis 22X is interposed between the two coupling surfaces FP1 and FP2.

Further, in the present embodiment, also in a state where the developing roller 12 is pressed against the photosensitive drum 5B by the pressure member 5C, the coupling 22 can be rotated in the first rotational direction D1 but can be prevented from rotating in the second rotational direction D2.

While the present embodiment of the present disclosure has been described, the present disclosure is not limited to the above-described embodiment. Various changes are conceivable without departing from the spirit of the disclosure.

In the above-described embodiment, the shaft 27B includes the plurality of first protrusions P1 and the clutch 40 includes the plurality of second protrusions P2. However, the shaft 27B need not necessarily include the plurality of first protrusions P1 and the clutch 40 need not necessarily include the plurality of second protrusions P2. For example, the shaft may include a single first protrusion. Further, the clutch 40 may include a single second protrusion. Furthermore, in the embodiment, the first protrusion P1 has the first shaft surface FS1 and the second shaft surface FS2. However, the first shaft surface FS1 and the second shaft surface FS2 need not necessarily be provided at a single protrusion. For example, one protrusion may have the first shaft surface. Further, another protrusion may have the second shaft surface. Similarly, one protrusion may have the first clutch surface. Further, another protrusion may have the second clutch surface.

In the above-described embodiment, both the second shaft surface FS2 and the second clutch surface FC2 are inclined surfaces inclined relative to the rotational direction. However, both the second shaft surface FS2 and the second clutch surface FC2 need not necessarily be inclined surfaces. For example, one of the second shaft surface and the second clutch surface may be an inclined surface.

In the above-described embodiment, the coupling 22 has two surfaces (FP1 and FP2) for moving the clutch 40 toward the second position. However, the number of surfaces for moving the clutch 40 toward the second position is not limited to two. The coupling 22 may have one surface or not less than three surfaces for moving the clutch 40 toward the second position.

In the above-described embodiment, the first coupling surface FP1 and the third clutch surface FC3 are inclined surfaces inclined relative to the rotational direction. However, both the first coupling surface FP1 and the third clutch surface FC3 need not necessarily be inclined surfaces. For example, one of the first coupling surface and the third clutch surface may be an inclined surface. Similarly, one of the second coupling surface and the fourth clutch surface may be an inclined surface.

In the above-described embodiment, the first bearing member 27 includes the shaft 27B. However, the first bearing member 27 need not necessarily include the shaft 27B. For example, the casing 11 may include the shaft 27B. In this case, the first bearing member 27 may have a hole to allow the shaft 27B to extend therethrough.

In the embodiment described above, the developing cartridge 10 is configured separately from the drum cartridge 5, but the developing cartridge 10 and the drum cartridge 5 may be integrally configured.

In the embodiment described above, a monochrome laser printer is exemplified as the image forming apparatus, but the image forming apparatus may be a color image forming apparatus. Furthermore, the image forming apparatus may perform exposure using LEDs. Moreover, the image forming apparatus may be a copier or multifunction device, for example.

Further, implementation can be performed with any combination of the components employed in the above-described embodiment and modifications.

What is claimed is:

1. A developing cartridge comprising:

a developing roller rotatable about a first axis extending in an axial direction;

a coupling for rotating the developing roller, the coupling being rotatable about a second axis extending in the axial direction;

a shaft rotatably supporting the coupling; and a clutch rotatable together with the coupling about the shaft in a case where the coupling rotates in a first rotational direction, wherein, in a case where the coupling rotates in a second rotational direction opposite to the first rotational direction, the clutch engages with a portion of the shaft and the clutch and the coupling do not rotate.

2. The developing cartridge according to claim 1, wherein the clutch is movable between:

a first position where the clutch engages with the portion of the shaft; and a second position where the clutch is disengaged from the portion of the shaft.

3. The developing cartridge according to claim 1, wherein the clutch is movable between:

a first position where the clutch engages with the portion of the shaft; and a second position where the clutch is spaced away from the portion of the shaft in the axial direction.

4. The developing cartridge according to claim 3, wherein the clutch is movable relative to the shaft in the axial direction.

5. The developing cartridge according to claim 3, wherein the clutch is movable relative to the coupling in the axial direction.

6. The developing cartridge according to claim 3, wherein the coupling is immovable relative to the shaft in the axial direction.

7. The developing cartridge according to claim 3, wherein the shaft has a hollow cylindrical shape, and wherein the clutch is rotatably supported by an inner circumferential surface of the shaft.

8. The developing cartridge according to claim 3, wherein the shaft has a first shaft surface and a second shaft surface, wherein, in a case where the clutch rotates in the second rotational direction, the first shaft surface faces the clutch in the second rotational direction and contacts the clutch, and wherein, in a case where the clutch rotates in the first rotational direction, the second shaft surface moves the clutch toward the second position.

9. The developing cartridge according to claim 8, wherein, in a case where the clutch contacts the first shaft surface, the first shaft surface stops rotation of the clutch in the second rotational direction.

10. The developing cartridge according to claim 8, wherein the shaft comprises a first protrusion having the first shaft surface and the second shaft surface.

11. The developing cartridge according to claim 10, wherein the shaft comprises a plurality of the first protrusions, and wherein the plurality of the first protrusions are arranged in a rotational direction of the coupling.

12. The developing cartridge according to claim 8, wherein the clutch has:

a first clutch surface configured to contact the first shaft surface; and a second clutch surface configured to contact the second shaft surface.

13. The developing cartridge according to claim 12, wherein the clutch comprises a second protrusion having the first clutch surface and the second clutch surface.

14. The developing cartridge according to claim 13, wherein the clutch comprises a plurality of the second protrusions, and wherein the plurality of the second protrusions are arranged in a rotational direction of the coupling.

15. The developing cartridge according to claim 11, wherein the clutch comprises a plurality of second protrusions, each of the plurality of second protrusions having:

a first clutch surface configured to contact the first shaft surface; and a second clutch surface configured to contact the second shaft surface, wherein, in a case where the coupling rotates in the first rotational direction, each of the second clutch surfaces of the second protrusions contacts a corresponding one of the second shaft surfaces of the first protrusions, so that the clutch moves to the second position and rotates together with the coupling, and wherein, in a case where the coupling rotates in the second rotational direction, each of the first clutch surfaces of the second protrusions contacts a corresponding one of the first shaft surfaces of the first protrusions, so that the rotation of the coupling in the second rotational direction stops together with the clutch.

16. The developing cartridge according to claim 8, wherein the coupling has a first coupling surface, and wherein, in a case where the clutch rotates in the first rotational direction, the first coupling surface moves the clutch toward the second position.

17. The developing cartridge according to claim 16, wherein a length of the first coupling surface in the axial direction is greater than a length of the second shaft surface in the axial direction.

18. The developing cartridge according to claim 16, wherein the clutch has a third clutch surface configured to contact the first coupling surface.

19. The developing cartridge according to claim 18, wherein the coupling has a second coupling surface, wherein, in a case where the coupling rotates in the first rotational direction, the second coupling surface moves the clutch toward the second position, and wherein the second coupling surface is positioned at an opposite side to the first coupling surface in a state where the second axis is interposed between the first coupling surface and the second coupling surface.

20. The developing cartridge according to claim 19, wherein the clutch has a fourth clutch surface configured to contact the second coupling surface, and wherein the fourth clutch surface is positioned at an opposite side to the third clutch surface in a state where the second axis is interposed between the third clutch surface and the fourth clutch surface.

21. The developing cartridge according to claim 1, wherein the coupling comprises a recessed portion at one end portion of the coupling in the axial direction, the recessed portion being configured to receive driving force.

22. The developing cartridge according to claim 1, further comprising a developing gear rotatable together with the developing roller about the first axis, wherein the coupling comprises a first gear in meshing engagement with the developing gear.

23. The developing cartridge according to claim 22, further comprising:

a supply roller rotatable about a third axis extending in the axial direction; and a supply gear rotatable together with the supply roller about the third axis, wherein the coupling further comprises a second gear in meshing engagement with the supply gear.

24. The developing cartridge according to claim 23, wherein a diameter of the first gear is different from a diameter of the second gear.

25. The developing cartridge according to claim 1, further comprising a bearing member comprising the shaft rotatably supporting the coupling, the bearing member having a hole through which a rotation shaft of the developing roller is inserted.

26. The developing cartridge according to claim 25, wherein the bearing member further comprises a developing agent receiving portion positioned at an end portion of the developing roller in the axial direction.

27. The developing cartridge according to claim 1, further comprises a casing configured to accommodate therein developing agent.

28. The developing cartridge according to claim 1, wherein the developing cartridge is attachable to a drum cartridge including a photosensitive drum and a pressure member configured to press the developing roller against the photosensitive drum, wherein, in a case where the coupling rotates in the first rotational direction in a state where the developing roller is pressed against the photosensitive drum by the pressure member, the clutch rotates together with the coupling, and wherein, in a case where the coupling rotates in the second rotational direction in a state where the developing roller is pressed against the photosensitive drum by the pressure member, the clutch and the coupling do not rotate.

* * * * *